US007219784B2

(12) United States Patent
Fargo

(10) Patent No.: US 7,219,784 B2
(45) Date of Patent: May 22, 2007

(54) BELT DRIVE ASSEMBLY FOR A PASSENGER CONVEYOR

(75) Inventor: Richard Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 133 days.

(21) Appl. No.: 10/543,287

(22) PCT Filed: Feb. 6, 2003

(86) PCT No.: PCT/US03/03724

§ 371 (c)(1),
(2), (4) Date: Jul. 25, 2005

(87) PCT Pub. No.: WO2004/071927

PCT Pub. Date: Aug. 26, 2004

(65) Prior Publication Data

US 2006/0137960 A1 Jun. 29, 2006

(51) Int. Cl.
*B66B 23/02* (2006.01)

(52) U.S. Cl. ..... 198/330; 198/326; 198/833

(58) Field of Classification Search ..... 198/321, 198/323, 326, 330, 833
See application file for complete search history.

(56) References Cited

U.S. PATENT DOCUMENTS 3,365,051 A * 1/1968 Mullis et al. ..... 198/330
3,658,166 A 4/1972 Hara et al.
3,967,720 A * 7/1976 Arieh ..... 198/833
4,058,204 A * 11/1977 Arieh ..... 198/833
4,082,173 A * 4/1978 Simon-Kochloffel ..... 198/330
4,535,880 A 8/1985 Boltrek
4,895,240 A * 1/1990 Bruehl et al. ..... 198/331
6,540,060 B1 4/2003 Fargo et al.

FOREIGN PATENT DOCUMENTS

GB 1086930 7/1966

OTHER PUBLICATIONS

PCT International Search Report PCT/US03/03724; Feb. 6, 2003.

* cited by examiner

*Primary Examiner*—James R. Bidwell
(74) *Attorney, Agent, or Firm*—Carlson, Gaskey & Olds

(57) ABSTRACT

A passenger conveyor drive belt assembly (40) includes a belt support (60) that facilitates proper engagement between the drive belt (42) and corresponding links (32) of a step chain (30) under selected conditions such as a full brake application. The belt support (60) preferably is positioned between a drive sheave (50) and an idler sheave (52) within the loop traveled by the drive belt. The belt support (60) includes at least one moveable support member (62) that does not contact the inner surface of the drive belt during normal operation conditions. In one example, the belt support (60) comprises a plurality of rollers (62).

12 Claims, 2 Drawing Sheets

BELT DRIVE ASSEMBLY FOR A PASSENGER CONVEYOR

FIELD OF THE INVENTION

This invention generally relates to passenger conveyor drive systems. More particularly, this invention relates to a drive belt assembly for a passenger conveyor.

DESCRIPTION OF THE RELATED ART

Passenger conveyors such as escalators or moving walkways typically include a plurality of steps or pallets that move in a loop pattern. A drive assembly for moving the steps typically is supported within a building structure underneath the corresponding floor or enclosed so that it is hidden from view. Over the years, there has been a desire to move away from overly complicated and large machinery. Those skilled in the art have strived to improve passenger conveyor drive systems to make them easier to incorporate into building structures and more economical, for example.

One difficulty associated with many escalator drive systems is the need for frequent maintenance or repair. Not only does this introduce costs for maintaining escalator systems, but it also presents a difficulty to maintenance technicians. The need to hide escalator drive components underneath floors or within other structures of a building necessarily places constraints on the ability to readily access components for repair or replacement.

There is a need for an improved escalator drive system. There are a variety of challenges and obstacles to be overcome in successfully designing such a drive system. This invention provides a unique belt drive arrangement that has a support assembly for ensuring satisfactory performance of the drive system in a variety of circumstances.

SUMMARY OF THE INVENTION

In general terms, this invention is an assembly for driving a passenger conveyor system. A drive assembly designed according to this invention includes a drive belt that has a cogged surface that is adapted to engage correspondingly configured links of a step chain associated with a plurality of steps. The drive belt forms a loop. A drive sheave is positioned at one end of the loop and engages an inner surface of the drive belt to move the belt around the loop. An idler sheave is positioned at an opposite end of the loop and engages the inner surface of the drive belt. The idler sheave moves with the belt responsive to movement of the drive sheave. A belt support is positioned between the drive sheave and the idler sheave. The belt support has at least one moveable element spaced from the inner surface of the belt yet close enough to engage the belt inner surface as the belt moves toward the belt support under certain conditions to ensure a desired engagement between the cogged surface of the drive belt and the links of the step chain links near the belt support.

The various features and advantages of this invention will become apparent to those skilled in the art from the following detailed description of the currently preferred embodiments. The drawings that accompany the detailed description can be briefly described as follows.

DETAILED DESCRIPTION

Figure 1:
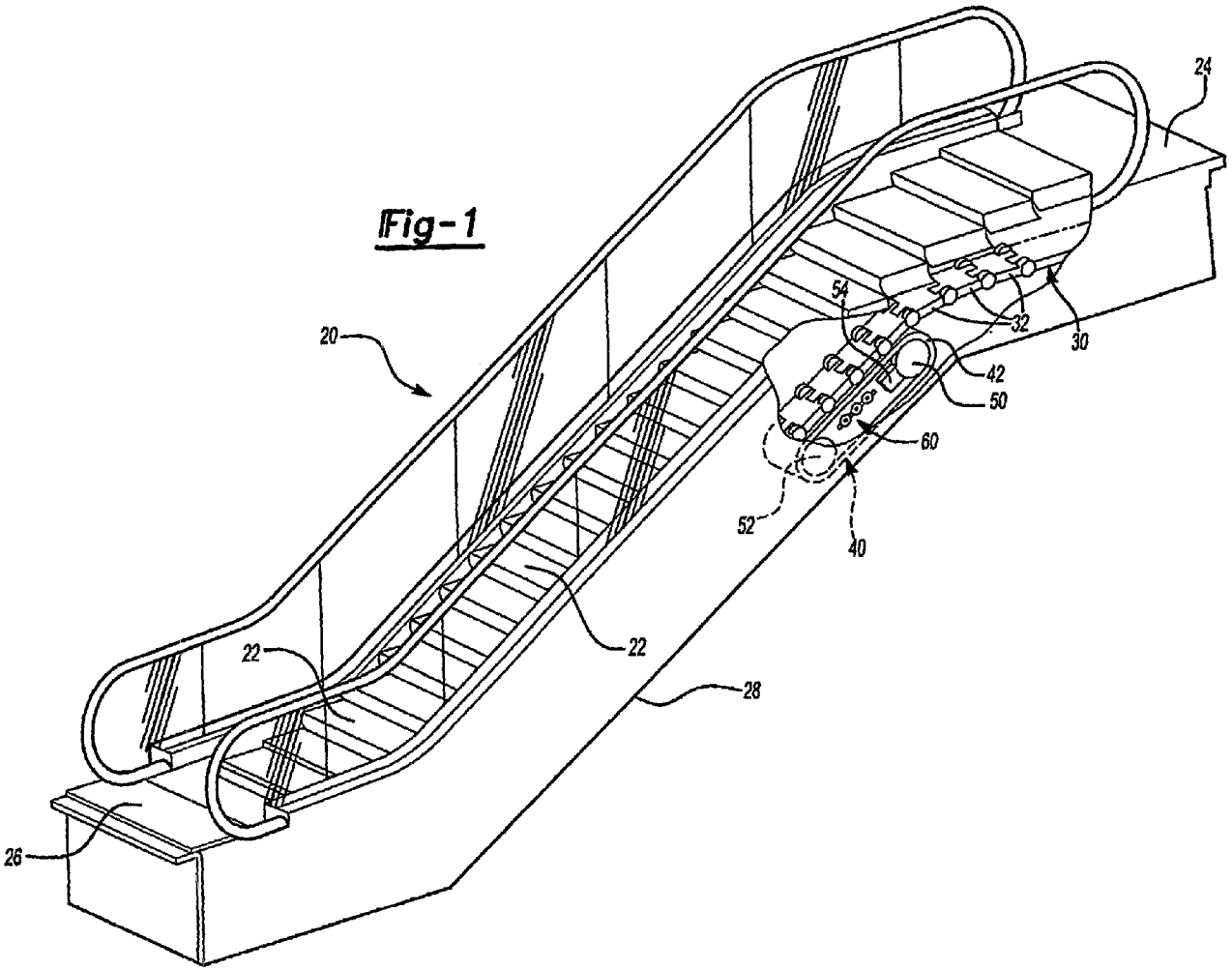
FIG. 1 diagrammatically illustrates an escalator system.

FIG. 1 shows a passenger conveyor system 20 that includes a plurality of steps 22 that are adapted to carry passengers between landings 24 and 26 in a conventional manner. An escalator is illustrated in FIG. 1 as an example passenger conveyor. This invention is equally applicable to moving walkways or other passenger conveyors.

Figure 2:
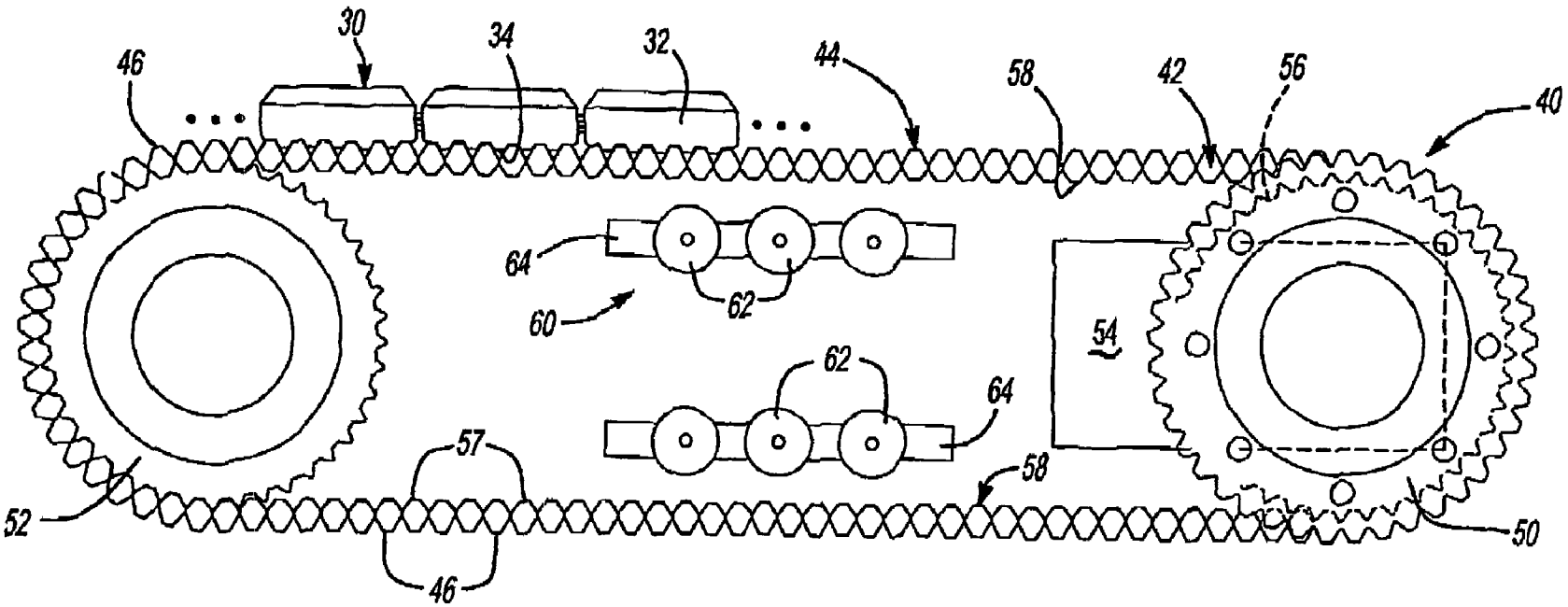
FIG. 2 schematically illustrates selected portions of an example embodiment of a drive assembly designed according to this invention.

Referring more particularly to the broken away portion of FIG. 1 and FIG. 2, a 25 step chain 30 is associated with the steps 22. The step chain 30 includes a plurality of step chain links 32 having teeth 34 that cooperate with a drive module 40 to provide the desired movement of the steps 22. The step chain 30 is associated with the steps 22 and any of a variety of known manners.

The drive module 40 includes a belt 42 having a toothed, outer engaging surface 44 with a plurality of teeth 46 that cooperate with the teeth 34 on the step chain links 32. The belt 42 preferably includes reinforcing members such as steel cords or polymer strands encased in a polymer material. As the belt 42 moves around a loop, the teeth 46 on the outer surface 44 engage the teeth 34 on the step chain links 32 to provide the desired movement of the step chain 30 and the steps 22.

The loop around which the belt 42 travels has a drive sheave 50 at one end and an idler sheave 52 at the other end. A drive machine 54 having a conventional motor and brake arrangement propels the drive sheave 50 such that a toothed surface 56 on the drive sheave 50 engages teeth 57 on an inner surface 58 of the belt 42 to propel the belt around the loop.

Under normal operating conditions, the teeth 46 on the belt 42 cooperate with the teeth 34 on the step chain links 30. According to this invention, the belt 42 is in proper, desired engagement with the step chain links 32 under normal operating conditions. There are situations, however, where unusually high loads are imposed on the step chain 30 and consequently the belt 42 where separation forces tend to separate the teeth 46 from the teeth 34. An example of such a situation is where a full brake application to stop the escalator occurs when there are passengers present on the escalator.

For such situations, the inventive arrangement includes a belt support 60 that operates to maintain proper engagement between the belt 42 and the step chain links 32 even under such unusual operation conditions. The belt support 60 includes at least one moveable member that is spaced from the inner side 58 of the belt 42 in a region of the belt between the drive sheave 50 and the idler sheave 52.

In the illustrated embodiment, the belt support 60 includes a plurality of rollers 62 that are supported on a bracket 64, which is supported by the structure supporting other portions of the drive module, which is associated with the escalator truss structure (not illustrated) in one example. The rollers 62 normally do not engage the inner surface 58 of the belt 42. Under selected operating conditions, such as a full brake application when separation forces tend to urge the belt 42 away from the step chain links 32, the belt 42 moves toward the belt support 60 until the inner surface of the belt 42 contacts the belt support 60, which maintains proper engagement between the teeth 46 on the belt 42 and the teeth 34 on the step chain links 32.

The illustration exaggerates the preferred spacing between the rollers 62 and the inner side of the belt 42. In one example, the outside surface of the rollers 62 that is closest to the inner side 58 of the belt 42 are separated by a distance in a range from approximately 0.5 to 1 millimeter. Such a spacing between the rollers 62 and the inner side of the belt 42 keeps the rollers from contacting the belt under normal operating conditions. Under the more severe operating conditions, such as the stop with a fall brake load, the rollers engage the belt and maintain the desired engagement between the belt 42 and the step chain links 32.

The rollers 62 in one example have an axial length that is equal to a width of the belt 42. The rollers 62 preferably have an outside dimension (i.e., diameter) that is substantially larger than a spacing between the teeth 58 on the inner side of the belt 42. The rollers 62 in one example have a smooth outside surface. A variety of materials may be selected for making the rollers 62, depending on the particulars of the belt 42.

The inventive arrangement has advantages compared to an arrangement where a belt support continuously engages the drive belt, for example. With this invention, there is no noise or vibration introduced by the backup rollers 62 during normal system operation. Additionally, the rollers and bearings can be less expensive components as they only operate under limited circumstances where noise or vibration are not a primary concern. The inventive arrangement, therefore, provides cost savings and enhanced system operation characteristics such as smoother and quieter movement.

Given this description, those skilled in the art will be able to realize appropriate support structures for maintaining the belt support 60 in a preferred location so that it operates as needed for a particular situation. The illustrated example includes a plurality of rollers 62 associated with each side of the belt loop.

Such arrangements are particularly useful where the step chain 30 and the belt 42 are engaged on both sides of the belt loop.

The preceding description is exemplary rather than limiting in nature. Variations and modifications to the disclosed examples may become apparent to those skilled in the art that do not depart from the essence of this invention. The scope of legal protection given to this invention can only be determined by studying the following claims.

I claim:

1. An assembly for driving a passenger conveyor system, comprising:

a drive belt that has an engaging surface that is adapted to engage correspondingly configured links of a step chain associated with a plurality of steps, the drive belt forming a loop;

a drive sheave engaging an inner surface of the drive belt to move the belt around the loop;

a second sheave spaced from the drive sheave and engaging the inner surface of the drive belt, the second sheave moving with the belt responsive to movement of the drive sheave; and a belt support positioned between the drive sheave and the second sheave, the belt support spaced from the inner surface of the belt a distance such that the support selectively engages the belt inner surface to ensure a desired engagement between the engaging surface and the links near the belt support.

2. The assembly of claim 1, wherein the belt support includes at least one moveable support member that moves responsive to contact with the belt.

3. The assembly of claim 2, wherein the belt support includes a plurality of rollers.

4. The assembly of claim 3, wherein the inner surface of the belt includes spaced teeth and the rollers have a diameter that is greater than a width of the spacings between the teeth.

5. The assembly of claim 3, wherein the rollers have an axial length that is approximately equal to a width of the belt.

6. The assembly of claim 3, wherein the rollers include an exterior surface that is smooth.

7. The assembly of claim 1, wherein the belt support normally does not contact the inner surface of the drive belt under normal conveyor system operation conditions and contacts the inner surface of the drive belt as the belt moves toward the belt support.

8. The assembly of claim 1, wherein the belt support includes at least one moveable member that engages the inner surface of the belt under selected conditions such as a full brake application.

9. The assembly of claim 1, wherein the belt support includes a plurality of rollers, some of the rollers positioned to selectively engage a first portion of the inner surface of the belt and others of the rollers positioned to selectively engage a second, oppositely facing portion of the inner surface of the belt.

10. A method of ensuring desired engagement between a drive belt and a step chain in a passenger conveyor system, comprising:

positioning a belt support near an inner surface of the drive belt such that the belt support does not engage the drive belt under normal operating conditions and selectively engages the drive belt inner surface to ensure the desired engagement between the drive belt and the step chain under selected operating conditions.

11. The method of claim 10, including providing a plurality of rollers spaced from the inner surface of the belt.

12. The method of claim 10, including maintaining the belt support in a fixed position and engaging the belt as the belt moves toward the belt support.

* * * * *